United States Patent [19]

Katz

[11] 4,060,386

[45] * Nov. 29, 1977

[54] ALKALINE HYDROGEN PEROXIDE BLEACHING METHOD

[76] Inventor: Jerome Katz, P.O. Box 1544, Rochester, N.Y. 14603

[ * ] Notice: The portion of the term of this patent subsequent to Nov. 11, 1992, has been disclaimed.

[21] Appl. No.: 609,735

[22] Filed: Sept. 2, 1975

Related U.S. Application Data

[63] Continuation-in-part of Ser. No. 312,637, Dec. 6, 1972, Pat. No. 3,918,898.

[51] Int. Cl.[2] ..... D06L 3/02

[52] U.S. Cl. ..... 8/111; 8/139; 252/95; 252/186

[58] Field of Search ..... 8/111, 139; 252/186, 252/95

[56] References Cited

U.S. PATENT DOCUMENTS

| | | | |
|---|---|---|---|
| 2,173,474 | 9/1939 | Evoy | 8/111 |
| 2,283,141 | 5/1942 | Kauffman et al. | 8/111 |
| 3,127,233 | 3/1964 | Lowes | 8/111 |
| 3,193,445 | 7/1965 | Parker et al. | 8/111 |
| 3,280,039 | 10/1966 | Smolens | 8/111 |
| 3,345,303 | 10/1969 | Schmid et al. | 8/111 |
| 3,686,126 | 8/1972 | Smeets | 252/99 |
| 3,756,774 | 9/1973 | Kirner | 8/111 |

*Primary Examiner*—William E. Schulz

*Attorney, Agent, or Firm*—Stuart J. Friedman

[57] ABSTRACT

A process for scouring, desizing and bleaching cotton greige goods comprises the steps of immersing the goods for a time sufficient to achieve commercial brightness in an aqueous solution have a temperature in the range from 100° to 212° F and consisting of from 0.3 to 70% by volume hydrogen peroxide, water and sufficient hydroxide to adjust the solution to a pH in the alkaline range, the solution being substantially free of heavy metal ions and maintained out of contact with all metals while the goods are immersed therein and cycling a portion of the solution through a filtration means to remove solid impurities therefrom while maintaining the volume, composition and pH of the solution in contact with the goods substantially the same. Preferably, the process is conducted as a simultaneous scouring, desizing and bleaching process in a temperature range 160° to 212° F in a solution including 1 to 50% by volume hydrogen peroxide, the goods being immersed in the solution for less than about 3½ minutes. In another embodiment, the goods are immersed in an alkaline scour solution for from 5 seconds to 3½ minutes prior to bleaching in the hydrogen peroxide solution, the alkaline scour solution having a temperature in the range 160° - 212° F and a pH from 10 to 14. Still another embodiment of the invention includes the alkaline scour plus an acid scour, in any sequence, prior to bleaching in the hydrogen peroxide solution.

33 Claims, 6 Drawing Figures

ALKALINE HYDROGEN PEROXIDE BLEACHING METHOD

This application is a continuation-in-part of my copending application Ser. No. 312,637, filed Dec. 6, 1972, now U.S. Pat. No. 3,918,898.

The present invention relates to bleaching of cotton griege goods and, more particularly, to a method of bleaching such goods in alkaline peroxide bleaching solutions.

Bleaching of cotton goods with hydrogen peroxide is well known and in general usage at the present time. Reference may be had to the following articles for an historical survey of the development of hydrogen peroxide bleaching:

Lynn, "Peroxide Bleaching of Textiles", American Dye Stuff Reporter, Oct. 5, 1969, pp. 20–25; Easton, "Bleaching Cottons with Hydrogen Peroxide", American Dye Stuff Reporter, July 9, 1962, pp. 23 to 30. The patent literature also contains references to bleaching with various peroxide type compounds, see U.S. Pat. Nos. 3,553,140, 3,481,827, 3,528,115, 3,350,160, 3,343,906, 3,280,039, 3,156,654, 3,034,851, 3,012,978, 2,886,532, 2,868,615, 2,828,181 and 2,720,440, as well as the patents cited in the above-referenced articles, and in the above-referenced patents. Solutions of hydrogen peroxide for simultaneously scouring and bleaching of cotton goods are described in U.S. Pat. No. 3,514,247 which teaches a process whereby the fabric is first saturated with the bleach solution in one zone and is then moved to a second zone in which it is heated to the bleaching temperature.

Presently known hydrogen peroxide bleaching methods all suffer from one or more disadvantages which can generally be classed as economic disadvantages or environmental disadvantages, or both. In general, these methods require intensive scouring pre-treatments prior to bleaching to remove impurities (such as coatings) which typically are found on or in cotton greige goods and these scouring pre-treatments require considerable time, high temperatures and generally high alkaline pH solutions. Those processes which manage to eliminate the pre-treatment, e.g., the process taught in U.S. Pat. No. 3,514,247, are extraordinarily wasteful of relatively expensive bleach solution and for this reason are uneconomical. Also, as will be appreciated, conventional peroxide bleaching methods and bleach solutions are complex in their chemistry. Some purposely use metallic vessels or add metal ions to activate peroxide decomposition and thereby reduce bleaching times. However, it is believed that discoloration of the cotton goods is produced by the process of oxidative coupling of these metals to the complex colored molecules of the fiber as it is bleached. Thus, the more complex the bleach bath is made, for example by the addition of stabilizers, chelating agents and additional metal ions, the higher the probability of oxidative couplings and the higher the probability of discoloration. In addition, the complex bleach solutions reject or reduce the effect of fluorescent brighteners. Indeed, it has been found that such brighteners become oxidized and rendered non-fluorescent in complex conventional bleach systems. It has also been found through experiments that tiny reddish specks, sometimes called "motes" in the bleaching trade, occur in the presence of a metallic system. Sometimes these "motes" can be eliminated by extending the bleaching time. However, additional bleaching time tends to weaken fabrics and is undesirably costly.

It is, therefore, one of the objects of the present invention to provide an improved bleaching process which reduces substantially the total goods treatment time.

It is another object of the invention to provide a bleaching process which conserves bleaching solution and which provides for filtering and recycling to extend the useful life of the solution.

It is still another object of the invention to accomplish satisfactory bleaching in the substantial absence of heavy metal ions and without the use of additives such as stabilizers, chelating agents, and the like.

It is yet another object of the invention to provide a bleaching process which is environmentally acceptable in that it minimizes the dumping of large quantities of waste chemicals.

It is still another object of the invention to provide a process for simultaneous scouring, desizing and bleaching of cotton greige goods to commercially acceptable whiteness levels in brief periods of time without damage to the goods.

It is yet another object of the invention to provide a process for the simultaneous scouring, desizing and bleaching of cotton greige goods to commercially acceptable whiteness levels in an energy savings mode, i.e., with minimum energy requirements.

Other objects and advantages will become apparent from the following description and appended claims.

Briefly described, the bleaching process in accordance with the present invention utilizes a substantially heavy metal ion free hydrogen peroxide aqueous solution in non-metallic containers and maintains the solutions out of contact with all metals while the goods are immersed therein. The goods to be bleached are immersed in the solution and may be simultaneously scoured, desized and bleached in very short times when the solution is heated to temperatures in the ranges of about 160° to 212° F and maintained at an alkaline pH above 7. Alternatively, at temperatures as low as 100° F the goods may be simultaneously scoured, desized and bleached in slightly longer periods of bleaching time. The hydrogen peroxide concentration in the solution may vary widely between about 0.3% and 70% by volume depending upon the other process parameters such as pH, temperature and bleaching time, although it is preferably maintained in the range 1 to 50% by volume. In one preferred form, the process may be accomplished by bleaching in a plurality of containers and continuously or intermittently cycling a portion of the solution in each container through a filtration means to remove solid impurities therefrom while replenishing the hydrogen peroxide solution concentration and adjusting its pH as necessary. At the same time, the volume of solution in each container in contact with the goods is maintained substantially the same. In another embodiment of the invention the goods are subjected to a very brief alkaline prebath or an acid and an alkaline pre-bath prior to bleaching to reduce the bleaching time while at the same time reducing the over-all goods treatment time and increasing the whiteness of the finished goods. These pre-baths will hereinafter be referred to as "scours" although it will be appreciated that they are quite different in duration and purpose from prior art pre-bleach scouring.

The foregoing and other objects and advantages of the present invention will become more readily apparent from the following description considered in conjunction with the accompanying drawings, in which.

Figure 1:
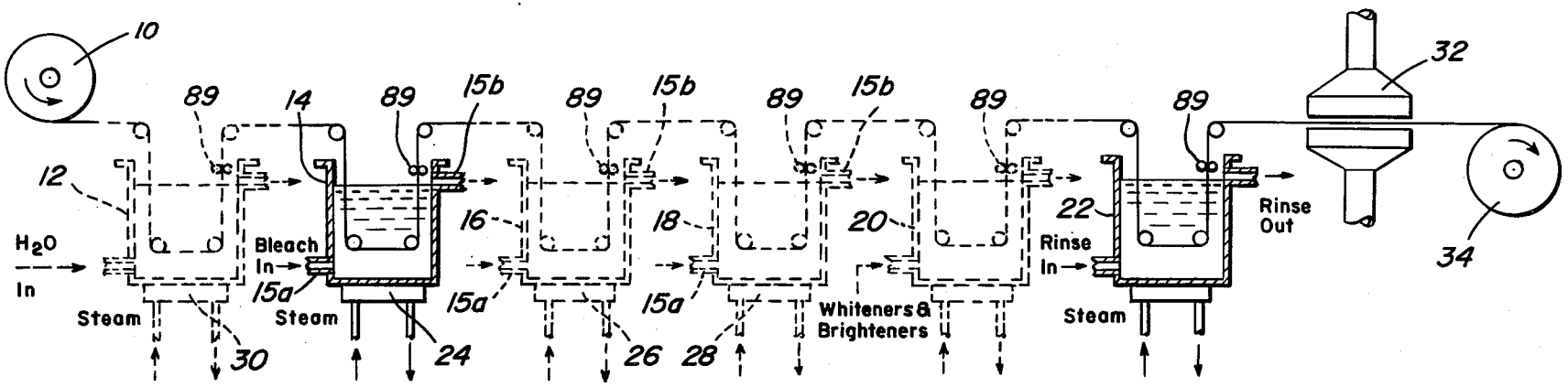
FIG. 1 is a schematic diagram illustrating a preferred bleaching method in accordance with the present invention, with optional steps shown in phantom.

Referring particularly to FIG. 1, the cotton greige goods to be bleached are fed off a roll 10 into and through a series of solution containing tanks or containers 12, 14, 16, 18 20 and 22. These containers may be of any structural material provided only that the portions thereof in contact with the solutions are of a non-metallic material. Glass or glass-lined metallic containers are suitable as are containers made of plastic materials, such as hard polypropylene.

The goods are passed from roll 10 into the bleaching, scouring and desizing solution which is contained in bleach container 14 and, optionally, additional bleach containers 16 and 18. The bleaching solution is circulated to and from each of these containers, preferably through a continuously or intermittently operating recirculating system which will be described hereinafter in connection with FIG. 2. Each of the bleaching containers is non-metallic, at least on the surfaces thereof that contact the bleaching solution. In one preferred form of the invention, the goods are passed to the first of three bleaching, scouring and desizing tanks or containers 14, through tank 14 and into tank 16, through tank 16 and into tank 18. The temperature of the solution in each of tanks 14, 16 and 18 is maintained within the desired range by heaters 24, 26 and 28, which may be steam operated heat exchangers. If desired, the goods may, prior to entering tank 14, be passed through a water dip tank 12 for periods up to 3½ minutes, which tank may contain tap, distilled or deionized water with the only limitation being that the water in the tank is substantially heavy metal ion free. Preferably the water in tank 12 is maintained at an elevated temperature above room temperature and between about 104° and 212° F by heater 30, which may be a steam operated heat exchanger. Dipping of the goods into the water in tank 12 serves to remove some of the impurities known to be present on and in the cotton greige goods and thereby reduces the subsequent contamination of the bleaching solutions by these impurities. In addition the water dip in tank 12, if used, brings the cotton goods up from ambient to the bleaching temperature. It will be appreciated that while the water pre-dip will remove some of the impurities on the goods, it will remove nowhere near the amount typically removed in the intensive scouring steps of the prior art. On the other hand, those impurities which are removed in tank 12 are prevented from entering the bleaching solution which, as is now well known, rapidly becomes contaminated with impurities from the cotton goods which turn the solution yellow and diminish the whiteness of the bleached goods. The total bleaching time in accordance with the present invention varies between ½ and 30 minutes depending on other process parameters, and is reduced somewhat if the water dip in tank 12 is utilized. The rate of travel of the goods through the tanks may be adjusted so that when more than one bleach tank is used the sum of the contact time with the bleach solution in each tank is sufficient to provide the total desired bleaching time.

After passing through the final bleach tank 18, the goods are passed through a rinsing tank 22 through which rinse water is circulated, and are then dried in a drier 32 which may be of a heated air-flow type. Finally, the goods are wound on a pickup reel 34. Alternatively, the goods may be continuously fed to the next process stage such as dying or cutting into pieces for further manufacture. If desired, the goods which exit bleaching tank 18 may be further whitened and brightened by passage through tank 20 to which are continuously fed blueing, optical brighteners, and the like, all as are well known in the art to further whiten and brighten the goods. Alternatively, but less desireably, the whiteners and brighteners may be added directly to one of the other solutions used in the process.

Figure 2:
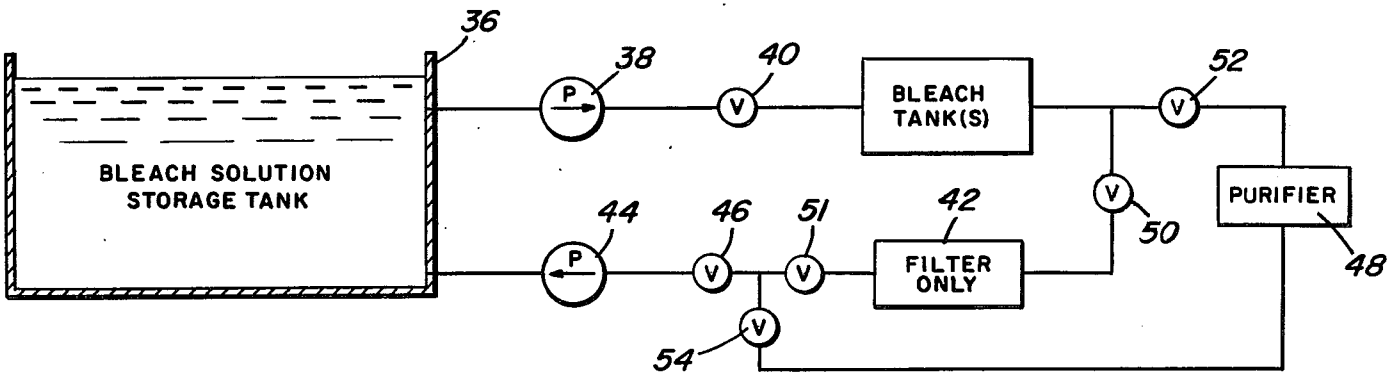
FIG. 2 is a schematic diagram in block form illustrating how the bleaching solution is continuously or intermittently recycled in the method illustrated in FIG. 1.

Inasmuch as the scouring, desizing and bleaching processes carried on in each of the tanks, even if pre-dip tank 12 is employed, results in some impurity contamination of the bleach solutions, with resulting yellowing, the system shown in FIG. 2 may be used on a continuous or intermittent basis for recirculating and reusing the bleach solutions and by avoiding continuous dumping, for achieving pollution control. The bleach solution is stored in a storage tank 36 to which additional solution may be added to make up for evaporation and depletion, to maintain peroxide concentration, and to maintain an adequate pH. Automatic sensors may be used to provide for the introduction of make-up solution so as to maintain proper bleaching solution strength (in terms of peroxide content) and pH. In one form the solution is pumped by means of a pump 33; the pressure and flow of the solution being controlled by a valve 40. The valve 40 is connected by piping to the inlet pipes 15*a* of each of the tanks 14, 16, and 18. The outlet pipes 15*b* from the tanks then are connected together and are piped via open valve 50 to a filter 42 which may be a mechanical filter such as a fiber or plastic screen or may be a microporous membrane. Sufficient back pressure is maintained by another pump 44 and a control valve 46. The filtered solution returns to the storage tank 36 to complete the recirculation system. After a period of use, the filter 42 may be cleaned and filtrate removed to a precipitating tank without polluting the environment in any way whatsoever.

In another embodiment of the invention, bleaching tanks 16 and 18 are not employed, nor is pre-dip tank 12. In this embodiment, all of the impurities present in the cotton greige goods contaminate the bleach solution per se and its effectiveness rapidly depletes. Mere filtration alone to remove solid impurities is sometimes insufficient to maintain the effectiveness of the solution. In such a case, the system shown in FIG. 2, with the addition of a purifier 48 through which the bleach solution is continuously or intermittently circulated is employed to remove the impurities from the contamined bleach solution. When used, open flow control valves 52 and 54 direct the flow through the system and valves 50 and 51 are closed. On the other hand, when purifier 48 is to be bypassed, valves 52 and 54 are closed and valves 50 and 51 are opened. Purification can be accomplished by distillation, reverse osmosis or adsorption by polymer adsorbants, by a combination of such methods, or by any known purification techniques to remove dissolved and suspended solids and oils. Although purification is necessary in many cases, as a general matter it is not desirable because purifying the peroxide solution destroys all components thereof, returning only pure water to the storage tank. Thus, the quantity of hydrogen peroxide which must be replenished to the system is quite large by comparison with a bleach system which employs a plurality of bleaching tanks and utilizes only filtration in lieu of purification. In connection with the latter type of system, it is noteworthy that the peroxide concentration in each of the bleach tanks 14, 16 and 18 need not be the same. In fact, it is particularly desirable that the peroxide concentration be highest in the first bleach tank 14 in order that the major proportion of the impurities can be removed in this tank.

Although it will be appreciated that the process is effective for the simultaneous scouring, desizing and bleaching of cotton greige goods over the broad parameter ranges indicated, the particular parameters selected depend to a large extent on the result desired. Moreover, since every cloth is different, no hard and fast rules can be cited which will apply in all cases. In addition, some bleach solutions are easier to use than others — 3.g., 70% by volume hydrogen peroxide is difficult to work with. And, irrespective of peroxide concentration, it is seldom desirable to bleach for more than 7 minutes unless energy savings are of paramount importance. Therefore, in an effort to furnish some guidelines for the use of the process, the following bleach solution concentration and pH conditions are generally effective and provide bleach solutions which are relatively easy to use where bleaching of carded, uncombed, commercial grade, cotton greige goods is to be accomplished at temperatures in the range 160° to 212° F in times of less than about 3½ minutes;

| pH | $H_2O_2$ - % BY VOLUME |
|---|---|
| 7(+) | 7.5 to 50% |
| 8 | 3.0 to 40% |
| 9 | 1.0 to 30% |
| 10 | 0.3 to 20% |
| 11 | 0.3 to 12.5% |
| 12 | 0.3 to 10% |
| 13 | 0.3 to 10% |
| 14 | 0.3 to 10% |

In the foregoing tabulation, the minimum peroxide concentration values at each pH represent the minimum at which commercially acceptable whitenesses, as hereinafter defined, can be expected. The maximum peroxide concentration values at each pH represent the maximums at which solution runaway due to the exothermic reaction of hydrogen peroxide and the pH adjusting alkaline additive, e.g., NaOH, can be avoided. In some instances, water jacketing of the bleach tank may be necessary to utilize the maximum peroxide concentrations indicated.

The following methods may be used to provide hydrogen peroxide which is substantially free of heavy metal ions:

Hydrogen peroxide can be made in a pure form essentially free of heavy metal ions by oxidizing in the liquid phase isopropyl alcohol or another secondary alcohol having 3 to 6 carbon atoms with oxygen or a gas containing oxygen at a temperature between 80° and 160° C under a pressure which is at least sufficient to allow the alcohol to remain in the liquid phase as described in U.S. Pat. No. 3,592,776, Fletcher et al, issued July 13, 1971. Since in this method the only catalyst used is hydrogen peroxide itself or a non-metalic free-radical producer such as azobisisobutyronitrile, the reaction starting materials are essentially free of heavy metal ions. Thus the hydrogen peroxide produced can be easily purified and concentrated by distillation with reduced danger of explosion.

Alternatively, suitable hydrogen peroxide may be purchased commercially as ACS reagent grade 30% designated 0004 HP 30 by Shell Oil Co. The following table gives the approximate analysis of this hydrogen peroxide:

TABLE

| | BAKER #2186 |
|---|---|
| Assay ($H_2O_2$) | 31.4% |
| Iron (Fe) | 0.00002% |
| Heavy Metals (as Pb) | 0.00003% |
| Ammonium ($NH_4$) | 0.0005% |
| Sulfate ($SO_4$) | 0.0002% |
| Phosphate ($PO_4$) | 0.00007% |
| Nitrate ($NO_3$) | 0.00007% |
| Chloride (Cl) | 0.0001% |
| Free Acid (as $H_2SO_4$) | 0.0004% |
| Residue after evaporation | 0.0006% |

In the event that organic impurities boiling at a higher temperature than $H_2O_2$ are present, they can be removed by counter-current, continuous, liquid-liquid extraction methods as described in U.S. Pat. Re. No. 25,114, original U.S. Pat. No. 2,949,343 by Hood et al.

Another hydrogen peroxide which can be used is also commercially available from the Shell Oil Co. as their 30% electronic grade which has the following analysis: Heavy Metal (as Pb) — 0.001%; Iron (as Fe) — 0.00005%; Silicon — 0.00005%; Nickel — 0.000002%; Chromium — 0.000002%.

The aforementioned Fletcher patent uses a method of reacting the $H_2O_2$ with urea to form a $H_2O_2$ urea adduct that can be easily precipitated from the reaction mixture and reacted with an extracting solvent such as acetone that decomposes the adduct and precipitates the urea. This leads to a solution of $H_2O_2$ in acetone that is extracted with more acetone and finally the acetone is removed by distillation.

The sodium hydroxide or the alkaline additive used to raise pH is also substantially free of heavy metal ions. For example, ACS, Reagent grade NaOH; Fisher Scientific Catalog #S-318 is suitable. This certified ACS NaOH contains 0.0003% iron.

As will be appreciated, there are a number of variables in the process of the present invention, e.g. bleach time, hydrogen peroxide concentration, pH of bleach solution and temperature of bleach solution. Surprisingly, it has been found that satisfactory whiteness can be achieved using concentrations of hydrogen peroxide in the broad range from 0.3% to 70% by volume; bleach solution pH in the alkaline range above 7; bleach solution temperatures in the range 100° to 212° F; and bleach times up to 30 minutes. It is particularly desirable to accomplish rapid simultaneous scouring, desizing and bleaching in periods of time not exceeding about 3½ minutes. To accomplish this in one form of the invention, the pH should be maintained above about pH 10, temperatures should be in the range about 160° to 212° F and hydrogen peroxide concentrations should be 0.5 to 15% by volume. Of course, it will be appreciated that such rapid scouring, desizing and bleaching is achieved at the expense of increased pH and increased temperatures and this embodiment of the process is relatively costly in its energy requirements, in its chemical costs notwithstanding the relatively low peroxide concentrations since the high pH depletes the peroxide rapidly, and in the need to reduce solution pH, as by ion exchange, prior to dumping spent bleaching solutions.

In another embodiment of the invention in which rapid simultaneous scouring, desizing and bleaching is accomplished in less than about 3½ minutes, the pH is lowered to the range 7 to 10. At these low pH's, and at temperatures of about 160° to 212° F, the peroxide concentration may advantageously be maintained in the range 1 to 50% by volume. This embodiment is also relatively energy expensive due to the high temperatures employed but effects some chemical expense savings due to the low pH and the attendant reduced rate of peroxide depletion. More importantly, the low pH levels substantially reduce the problems and expense incident to dumping spent bleaching solutions and to some extent reduce the deleterious bleach solution fumes common to high alkaline solutions.

Still another embodiment of the invention which is advantageously practiced may be considered the energy savings mode. According to this embodiment, pH levels are kept close to neutral, in the range 7 to 8 and temperatures are maintained relatively low, in the range 100° to about 150° F. Under these conditions, high peroxide concentrations in the range 30 to 70% by volume are preferred although at temperatures below 110° and at pH about 7, it is recommended that the peroxide concentration be at least 40% by volume. Most preferred when operating at low peroxide concentrations (about 30% by volume) and at pH's about 7 is to maintain the bleach solution at temperatures above about 112° F. The energy savings incident to the use of low temperatures are the most attractive aspect of this embodiment and render the process extremely economical notwithstanding the increased chemical costs due to use of high concentration peroxide solutions. Of course, under these conditions bleaching takes somewhat longer and commercially acceptable whitenesses are achieved in about 15 to 30 minutes.

One generally accepted measure of the success or extent of bleaching is measurement of the resulting fabric "base white" which can be defined as the whiteness of a piece of fabric after it has been bleached but prior to bluing or optical brightening. Whiteness is measured in terms of percentage reflection compared to some standard of pure white, such as MgO, $BaSO_4$ or Vitrolite, with respect to a source of light. The source is monochromatic and is impinged upon and reflected from the sample. Using a prism or grating, the reflected light is divided into its various components and its intensity is measured by a photocell. The comparative intensity is expressed as a percentage of the intensity of the reflection from the standard. Thus, it will be appreciated, that no matter how much a fabric has been bleached, it will never achieve a pure white shade. Its base white is always less than 100 and, in fact, its reflected color is always a shade of yellow.

The whiteness of a fabric (although not its "base white") can be increased by neutralizing the reflected yellow. Since blue is the complement of yellow, the addition of a blue dye to the fabric neutralizes the yellow while at the same time absorbing light striking it. The result is an increase in the whiteness (i.e., a decrease in the yellowness) but an over-all darkening of the color. On the other hand, fluorescent whiteners absorb light mostly in the ultraviolet region and emit blue fluorescence. The blue fluorescence neutralizes the yellow and increases the whiteness of the fabric. However, there is no over-all darkening attending use of fluorescent whiteners since their absorption is primarily in the ultraviolet region and not in the visible region. In fact, as long as too much whitener is not used the effect is to increase the apparent whiteness of the fabric. As a consequence, it has been found that by a proper balance of blueing and fluorescent whiteners, a considerable whitening of the fabric can be accomplished.

The amount of whiteness desired in bleached fabric depends upon the ultimate intended usage of the fabric. Thus, if the fabric is to be color dyed, it is of no real consequence that its base white is somewhat lower than that of fabric which is not to be dyed. Generally speaking, commercially acceptable base whites are in the range 65 to 80. However, there is another aspect to commercially acceptable bleaching. Due to the presence of cotton husks or other particulate impurity matter in the unbleached, uncombed greige goods, it is possible to bleach the bulk of the cloth to a whiteness exceeding 65 while not successfully bleaching a substantial number of these particulate impurities, with the result that the cloth appears white but contains unbleached specks therein. From a practical viewpoint, a few unbleached specks per 12 inches × 12 inches section of fabric are commercially tolerable because they are relatively unnoticeable and because subsequent whitening and brightening will probably remove the specks. Therefore, when commercially acceptable whitenesses or commercially acceptable bleaching is referred to herein it means a whiteness of at least 65 with no more than a few specks per 12 inches × 12 inches cloth section.

Thus, in accordance with the present invention, a number of fabric samples were simultaneously scoured, desized and bleached in hydrogen peroxide solution with the result that commercially acceptable base whites were achieved within the hereinbefore defined pH temperature, concentration and bleach time limitations of the instant method.

The following examples are illustrative of the present process.

EXAMPLE I

A 1.5% by volume aqueous hydrogen peroxide solution substantially free of heavy metal ions and having a pH of 11.5 was placed in a single non-metallic (glass) tank and heated to 190° F. Cotton greige goods in the form of cotton knit fabric were desized, scoured and bleached to commercial brightness after immersion in the tank for 3 minutes and 30 seconds.

EXAMPLE II

The solution of Example I was adjusted to pH 11.75 with sodium hydroxide which was free of heavy metal ions and was used in a glass tank at a temperature of 185° F. Cotton greige goods in the form of cotton knit textile was scoured, desized and bleached after immersion in the tank for 3 minutes and 20 seconds. Thereafter, the goods were rinsed and dried and had commercially acceptable brightness.

EXAMPLE III

Sufficient sodium hydroxide was added to the hydrogen peroxide solution of Example I to increase the pH to 12. The resulting solution was placed in three tanks as illustrated in FIG. 1 and heated to 185° F. Cotton greige goods were continuously passed through the tanks for a total bleach time of 3 minutes and 15 seconds. After the goods were rinsed and dried, they had commercially acceptable brightness.

EXAMPLE IV

To each of five separate hydrogen peroxide solutions having the composition set forth in Example I was added one of five different commercially available fluorescent whiteners. The solutions were heated to 185° F. In each case, the amount of whitener added was about 10 ounces of whitener per each 10 gallons of peroxide solution. Cotton knit fabric goods were immersed in each solution for 3 minutes and 15 seconds. They were simultaneously scoured, desized, bleached and whitened to a high degree of brightness, well beyond the minimum of 65 for commercial acceptability.

EXAMPLE V

A 30% by volume solution of aqueous hydrogen peroxide having a pH of 7.1 was poured into a glass lined, stainless steel tank. The solution in the tank was substantially free of heavy metal ions and was heated to 168° F. Bleaching continued for 7 minutes after which time the cotton goods had commercially acceptable whiteness.

EXAMPLE VI

A number of aqueous hydrogen peroxide bleach solutions having various pH levels, all of which were substantially free of heavy metal ions, were prepared at concentration levels ranging from less than 1% by volume hydrogen peroxide up to 50% by volume hydrogen peroxide. Some of the cotton greige goods were pre-dipped in heavy metal ion free water prior to bleaching. Following bleaching in a glass container, each sample was rinsed and dried and base white readings made thereon. The following Table I summarizes the pre-dip and bleach conditions and the resulting base whites.

TABLE I

| | WATER PRE-DIP | | BLEACH | | | | |
|---|---|---|---|---|---|---|---|
| | Temp. (° F.) (Approx.) | Time (Sec.) | $H_2O_2$ % by Vol. | Temp. (° F) | pH | Time (Min.) | BASE WHITE |
| (a) | 140 | 45 | .75 | 212 | 13.2 | 3½ | 75.7 |
| (b) | 212 | 10–15 | 3 | 212 | 10 | 3½ | 74.3 |
| (c) | 140 | 45 | 3 | 185 | 11.8 | 3½ | 73.4 |
| (d) | 212 | 90 | 3 | 212 | 13.25 | 3½ | 76.3 |
| (e) | 212 | 90 | 3 | 212 | 13.25 | 5 | 77 |
| (f) | 212 | 90 | 3 | 212 | 13.25 | 15 | 77 |
| (g) | 212 | 10 | 5 | 212 | 13 | 1 | 73.4 |
| (h) | 212 | 10 | 5 | 212 | 13 | 3½ | 78.6 |
| (i) | 140 | 45 | 7.5 | 212 | 13 | 1 | 75.6 |
| (j) | 140 | 45 | 7.5 | 212 | 13 | 1¾ | 76.7 |
| (k) | 140 | 45 | 7.5 | 212 | 13 | 3½ | 76.7 |
| (l) | | | 10 | 185 | 10.8 | 2 | 73 |
| (m) | | | 10 | 185 | 10.8 | 3½ | 78 |
| (n) | | | 15 | 185 | 9.5 | 2 | 73 |
| (o) | | | 15 | 185 | 9.5 | 3½ | 78.5 |
| (p) | | | 30 | 212 | 7.7 | 1½ | 76 |
| (q) | | | 30 | 212 | 7.7 | 3½ | 79 |
| (r) | | | 50 | 212 | 7.25 | ¾ | 78.8 |

EXAMPLE VII

Cotton greige goods were simultaneously scoured, desized and bleached to commercially acceptable base whites in the energy savings mode by employing bleach baths having the following make-up for the time periods indicated:

a. 30% by volume aqueous hydrogen peroxide at pH 7.7 and about 108° F for 21 minutes.

b. 50% by volume aqueous hydrogen peroxide at pH 7.25 and about 122° F for 20 minutes.

Figure 3:
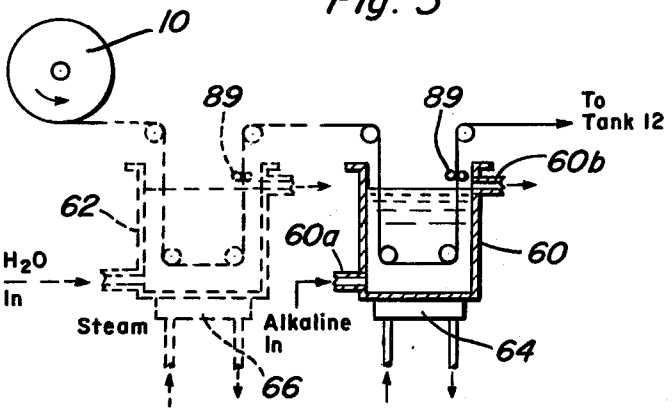
FIG. 3 illustrates the method of FIG. 1 utilizing an alkaline scour prior to bleaching with optional steps shown in phantom.

Referring now to FIG. 3, in another form of this invention, an aqueous alkaline scour bath having a pH maintained in the range 10 to 14 and a temperature in the range 160°–212° F is employed preliminary to bleaching. It has been found that the addition of a short alkaline scour pre-treatment decreases the bleach time; permits the use of a single bleach bath without the need for bleach bath purification; reduces the amount of peroxide used to oxidize the colorants in the cloth; and avoids weakening the cloth by extended bleach baths. However, pre-scour treatments are not always desireable and particularly are not necessary where strong peroxide bleach solutions are employed. For example, referring to Table I, last entry, wherein a very white result is achieved in only about 45 seconds in the simultaneous process, the bleach solution identified there is much too strong to warrant a pre-scour and any pre-scour would be wasteful and possibly harmful to the goods.

In this embodiment, the cotton goods from roll 10 are immersed in a continuous fashion in the alkaline scour bath contained in tank 60 for a period of time ranging from 5 seconds to 3½ minutes preferably from 1 to 3 minutes. The alkaline bath may be any strong base which can furnish the desired pH levels, for example, the alkali and alkaline earth hydroxides, preferably KOH or NaOH due to their ready availability and low cost. If desired, an optional water pre-dip may be employed prior to alkaline scouring by passing the goods through tank 62 which contains water at a temperature from above room temperature to 212° F. The temperatures of the solutions in tanks 60 and 62 are maintained within the desired ranges by heaters 64 and 66, which may be steam operated heat exchangers. As with the bleach baths, the alkaline solution and water employed are all substantially free of heavy metal ions and the portion of tanks 60 and 62 in contact with the solutions therein are non-metallic. At the same time, the solutions are maintained out of contact with all metals while the goods are immersed therein. In one preferred embodiment, the alkaline pre-bath has a pH in the range 11.8 to 13.5, a temperature of 185° – 212° F and a time of immersion of 1 to 3 minutes. A useful base white can be achieved following this preferred alkaline scour by immersing the goods in a hydrogen peroxide bleach solution for about 1 minute.

On economic balance, use of an alkaline scour renders the process more expensive than the hereinbefore described simultaneous scouring, desizing and bleaching, since the alkaline scour process embodiment requires an additional hydroxide bath, associated monitoring equipment, and the like. On the other hand, the over-all process is rendered more economical by use of the relatively short alkaline pre-bath since bleaching time is reduced and the burden of removing colorants from the cloth falls upon the pre-bath not the bleach solution, and any need for purifying the bleach solution is eliminated with an attendant savings in energy and chemical costs.

Notwithstanding that the length of time the goods are immersed in the scour bath is short, such a bath is so efficient in removing contaminants that it yellows very rapidly and pollution control may be accomplished by intermittent or continuous recycling, replenishing and purifying the alkaline scour bath to remove the contaminants therefrom, while only filtering and replenishing the bleach bath. This accounts for a large savings in energy and a particularly large savings in the cost of peroxide chemicals.

In one optional form of the alkaline scour bath, the bath comprises a high pH hydrogen peroxide solution. In this manner, scouring is accompanied by oxidation and a very large proportion of the contaminants in the cloth are removed. Thus, the duration of the final bleach bath may be reduced to a comparatively short period of time and very little recycling and replenishing thereof is necessary. For example, in one continuous process, the scour bath may contain 1 to 10% by volume hydrogen peroxide at a temperature in the range 170° - 212° F and a pH of 10.75 to 14. Immersion in this bath for a period from 10 seconds to 2 minutes, preferably about 30 seconds, at pH 13.25 and 212° F in a 10% peroxide bath, followed by an optional rinse in water substantially free of heavy metal ions, and then followed by a 45 second to 3 minute bleach in 10 to 50% hydrogen peroxide at 170° - 212° F and a pH 10.75 to 14, preferably 15% peroxide by volume at least 205° F and a pH of 12–12.5 for 1½ minutes produces outstanding base whiteness.

Figure 5:
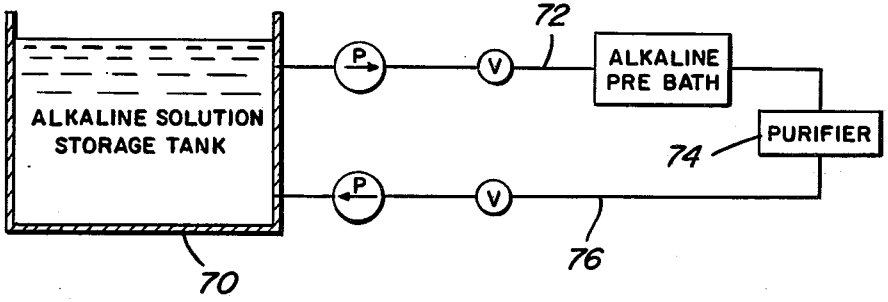
FIG. 5 is a schematic diagram in block form illustrating how an alkaline scour solution used in the methods in FIGS. 3 and 4 is continuously or intermittently recycled.

It is, of course, quite surprising in view of the prior art's requirement for extensive and prolonged scouring that scouring and desizing can be accomplished to such a substantial extent in about 1 minute followed by complete bleaching in times of about 1 minute. Particularly advantageous is that solution purification can be limited to the scour solution while bleach solution treatment can be accomplished largely by filtration and replenishment. As a result, the energy and chemical costs of such a system are less than any heretofore suggested. In this connection, reference is made to FIG. 5 where a system for recycling, purifying and replenishing the alkaline scour bath is shown. The alkaline scour solution is stored in tank 70 to which additional solution may be added to make up for evaporation and depletion, to maintain alkaline scour solution concentration, and to maintain an adequate pH. Automatic sensors may be used to provide for the introduction of make-up solution so as to maintain proper scour solution strength and pH. Pumps and valves are employed in a manner similar to that described in connection with FIG. 2 to control flow of the scour solution in the system. The storage tank outlet line 72 is connected to the inlet **60*a* of tank 60. The outlet 60*b* of tank 60 is piped through purifier 74 wherein dissolved and suspended solids, oils and the like impurities are removed and then through storage tank return line 76 to tank 70**. It is believed that when the alkaline scour bath is continuously recycled, replenished and purified considerable scouring can be achieved in very short periods of time and the bleach times necessary are thereby much reduced. By removing the yellow coloring matter formed in the alkaline scour bath as fast as it is formed, a synergistic effect is noted which decreases the scour time by an unaccountably large factor and, at the same time, considerably decreases the bleaching time.

The following Examples are illustrative of the process employing an alkaline pre-scour.

EXAMPLE VIII

Using glass containers and solutions which were substantially free of heavy metal ions, cotton goods were treated under the following conditions to produce commercially acceptable base whites.

ALKALINE SCOUR

Sodium hydroxide having pH 13.25 at 212° F for 45 seconds.

BLEACH

5% by volume hydrogen peroxide having pH 12.75 at 210° F for 1¾ minutes.

The scour solution was continuously purified and replenished. The bleach solution was continuously filtered and replenished.

EXAMPLE IX

Using glass containers and solutions which were substantially free of heavy metal ions, cotton goods were treated under the following conditions to produce commercially acceptable base whites.

ALKALINE SCOUR 4.5% by volume hydrogen peroxide and sodium hydroxide having a solution pH of 13.2 at 212° F for 30 seconds.

BLEACH

5% by volume hydrogen peroxide having pH 13.5 at Pb 212° F for 1 minute and 15 seconds.

The scour solution was continuously purified and replenished. The bleach solution was continuously filtered and replenished.

EXAMPLE X

The same procedure as in Example IX was carried out except that 7% by volume hydrogen peroxide was used in the bleach solution for 1 minute.

EXAMPLE XI

The same procedure as in Example IX was carried out except that 3.5% by volume hydrogen peroxide was used in the bleach solution for 1 minute and 45 seconds.

EXAMPLE XII

A number of aqueous hydrogen peroxide bleach solutions having various pH levels, all of which were substantially free of heavy metal ions, were prepared at concentration levels ranging from .75 to 15% by volume hydrogen peroxide. The same cotton greige goods were subjected to an alkaline scour and then immersed in each bleach solution in a glass container, rinsed and dried and base white readings made thereon. The following Table II summarizes the scour and bleach conditions and the resulting base whites.

TABLE II

| | ALKALINE SCOUR | | | BLEACH | | | | |
|---|---|---|---|---|---|---|---|---|
| | pH | Temp. (° F) | Time (Min.) | $H_2O_2$ % by Vol. | Temp. (° F) | pH | Time (Min.) | BASE WHITE |
| (a) | 13.5 | 212 | ½ | .75 | 212 | 13 | 1 | 67 |
| (b) | 13.5 | 212 | ½ | .75 | 212 | 13 | 1¾ | 69.5 |
| (c) | 13.5 | 212 | ½ | .75 | 212 | 13 | 3½ | 74 |
| (d) | 13 | 212 | 1 | 3 | 185 | 12 | 1 | 67 |
| (e) | 13 | 212 | 1 | 3 | 185 | 12 | 3½ | 75 |
| (f) | 13 | 212 | 1 | 3 | 212 | 12 | 3½ | 77.2 |
| (g) | 13.8 | 212 | 1 | 5.1 | 212 | 13.3 | 1 | 74.1 |
| (h) | 13.8 | 212 | 1 | 5.1 | 212 | 13.3 | 1¾ | 76.1 |
| (i) | 13.8 | 212 | 1 | 5.1 | 212 | 13.3 | 2½ | 76.4 |
| (j) | 13.8 | 212 | 1 | 5.1 | 212 | 13.3 | 3½ | 77.7 |
| (k) | 14 | 212 | ½ | 15 | 212 | 7.1 | 3½ | 79 |

Figure 4:
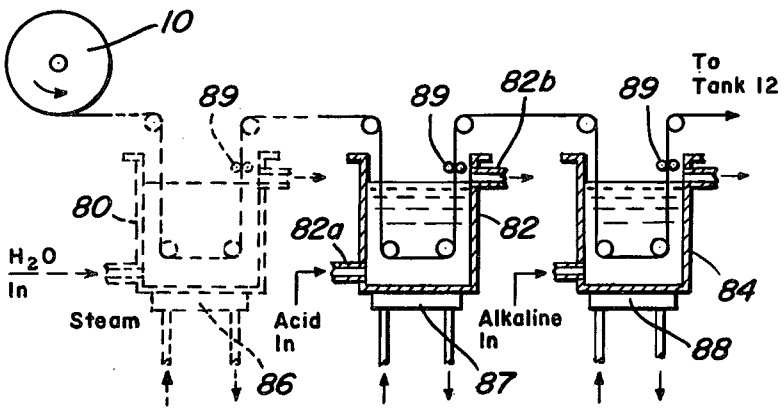
FIG. 4 illustrates the method of FIG. 1 utilizing separate alkaline and acid scours prior to bleaching, with optional steps shown in phantom.

Still another embodiment of the present invention is shown in FIG. 4 wherein an acid scour bath substantially free of heavy metal ions preliminary to the alkaline scour bath of FIG. 3 is employed to produce an instantaneous cracking of the sizing and chemical coatings of the fibers in the cotton greige goods. The effect is akin to a type of explosive hysteresis wherein the pH cycling in the scour baths causes the fibers to swell and contract and the oils, chemicals and coatings to be solubilized rather rapidly by the alternate contraction and swelling. In this manner, the contaminants on the goods are explosively removed from the fibers. As can be seen from FIG. 4, the cotton goods may first be moved from roll 10 to an optional water dip in tank 80 at a temperature from above room temperature to 212° F. Following the water dip if it is used or directly from roll 10, the cotton goods are immersed in tank 82 in an acid solution having a pH in the range up to about 3.0, desirably less than about pH 1, at a temperature in the range 45°–212° F for a very brief time from 1 to 10 seconds. Immediately upon exiting the acid bath, the goods are immersed in tank 84 containing an alkaline scour bath as has been previously herein described. The temperatures of the solutions in tanks 80, 82 and 84 are maintained within the desired ranges by heaters 86, 87, 88 which may be steam operated heat exchangers. It is the contractions and swelling caused by the alternating acid and base baths which cause the rapid, almost explosive, removal of contaminants from the cloth. Following the alkaline scour bath, and as has already been described, the goods move through an optional dip in water in tank 12 after which they are subjected to hydrogen peroxide bleaching. The bleach solution which is employed may be substantially the same as has hereinbefore been described. However, the great advantage of this embodiment of the process depicted in FIG. 4 is that bleaching is extraordinarily rapid and extraordinarily high whitenesses are achieved with practically no contamination whatever of the peroxide bleach bath. Thus, it is only necessary to minimally recycle, filter and replenish the hydrogen peroxide bleach bath and purification efforts can be limited to the acid and alkaline scour baths.

Figure 6:
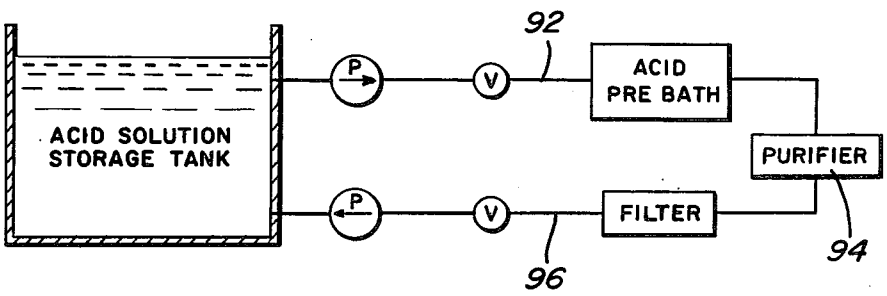
FIG. 6 is a schematic diagram in block form illustrating how the acid scour solution used in the method of FIG. 4 is continuously or intermittently recycled.

Thus, with reference to FIG. 6, there is shown the system which can be used to intermittently or continuously recycle, purify and replenish the acid scour bath. The acid scour solution is stored in tank 90 to which additional solution may be added to make up for evaporation and depletion, to maintain acid scour solution concentration, and to maintain an adequate pH. Automatic sensors may be used to provide for the introduction of make-up solution so as to maintain proper scour solution strength and pH. Pumps and valves are employed in a manner similar to that described in connection with FIG. 2 to control flow of the acid scour solution in the system. The storage tank outlet line 92 is connected to the inlet **82*a* of tank 82. The outlet 82*b* of tank 82 is piped through purifier 94 and then through storage tank return line 96 to tank 90. The system shown in FIG. 5 would, of course, be used to recycle, replenish, and purify the alkaline scour solution from tank 84**.

There is, of course, an additional cost factor incident to employing the acid bath. However, the surprising efficiency of the combined acid-alkaline scour baths in removing contaminants markedly reduces the bleach time and the waste of bleach chemicals and the attendant savings more than offsets the additional costs incident to the process. In addition, the whitest bleached cloths result from using the acid-alkaline scour. Moreover, total scour time is generally less than the scour time if only the alkaline bath is used and a 10 second acid-10 second alkaline scour can achieve results comparable to a 1 minute alkaline scour alone. Furthermore, bleach times are reduced by about 25% compared to the alkaline scour process embodiment with total pre-treatment and bleach times in the range 1 minute to 1½ minutes where high concentration, high pH and high temperature bleach solutions are used. It is also noteworthy that the order of the scour baths is unimportant and can be reversed and the alkaline scour can be accomplished prior to the acid scour.

It is preferred that the acid bath have a pH in the range less than 3 and preferably 0.5 to 1, a temperature in the range 45° to 120° F and more preferably 50° – 85° F, and a total immersion time of 1 to 10 seconds, preferably 1 to 5 seconds and usefully .5 to 3 seconds. Any strong acid can be used which can achieve these pH levels.

The following Examples are illustrative of the process employing separate acid and alkaline scour baths prior to bleaching.

EXAMPLE XIII

Using glass lined containers and all solution ingredients substantially free of heavy metal ions, and continuously purifying and replenishing the scour baths and filtering and replenishing the bleach baths, four samples of cotton greige goods were immersed sequentially in the following solutions under the indicated conditions:

1. Tap water at 212° F for 10 seconds;
2. HCl solution at pH 0.65 at 68° F for 2 seconds;
3. NaOH solution at pH 14 and 212° F for 10 seconds;

4. 3% by volume hydrogen peroxide bleach solution at pH 14 and 212° F for times of (a) 45 seconds, (b) 1 minute, (c) 1¾ minutes and (d) 3½ minutes.

The following base whites were measured:

a. 70.6 at 45 seconds;
b. 73 at 1 minute;
c. 75.9 at 1¾ minutes; and
d. 78.5 at 3½ minutes.

It is noteworthy that the total pre-treatment time was only 22 seconds and that base whites in excess of 70 were achieved with as little as 45 seconds of bleach, a total of only 67 seconds of goods treatment time.

EXAMPLE XIV

Using glass lined containers and all solution ingredients substantially free of heavy metal ions, and continuously purifying and replenishing the scour baths and filtering and replenishing the bleach baths, cotton greige goods were immersed sequentially in the following solutions under the indicated conditions:

1. NaOH solution at pH 14 and 212° F for 80 seconds;
2. HCl solution at pH 0.9 and 68° F for 5 seconds;
3. 30% by volume hydrogen peroxide bleach solution at pH 7.1 and 212° F for 3½ minutes.

The resulting bleached cloth had a base white of 80.

In moving the goods from bath to bath, in any of the processes described in connection with FIGS. 1, 3 or 4, it is desireable to preclude carry-over of solutions from tank to tank. The reason is obviously to prevent the solution in each succeeding tank from becoming contaminated by the solution from the preceding tank. This is particularly so because the concentration, temperature and pH of each solution, as has hereinbefore been noted, influences the efficiency of that solution for its particular task. Thus, utilizing FIG. 5 for descriptive purposes, it would be extremely undesireable to carry-over the low pH acid solution from tank 82 into the high pH alkaline solution in tank 84. Likewise, carry-over of high pH alkaline solution from tank 84 into neutral water-dip solution in tank 12 would adversely affect the pH of the solution in tank 12. For these reasons it is recommended that the goods pass through squeeze rollers 89 as they emerge from each solution, whereby the solution is forced from the goods and drips back into each tank.

Another problem associated with moving goods from tank to tank is that the goods tend to lose heat and reduce in temperature between the time they emerge from one solution and enter the next solution. Particularly where there is a relatively small solution to fabric ratio in the tank, the goods cause the solution in the tank to drop in temperature from the desired temperature, with attendant loss in operating efficiency. In part, optional water-dip baths in tanks 12, 66 and 86 serve to raise the fabric temperature and thereby to somewhat alleviate this problem. A better, albeit more costly solution, is to provide heated rollers (not shown) at the inlet to each tank and to cause the fabric to pass between these rollers prior to entering the solution in the tank. If the rollers are heated by steam, for example, their temperature can be controlled to correspond the temperature of the fabric to that of the solution it is about to enter.

While the present invention has been described with respect to particular embodiments thereof, it will be understood by those skilled in the art that numerous modifications can be made without actually departing from the invention. Accordingly, all modifications and equivalents may be resorted to which fall within the scope of the invention as claimed.

What is claimed as new is as followed:

1. A process for scouring, desizing and bleaching cotton greige goods comprising the steps of:

a. immersing said goods for a time sufficient to achieve commercial brightness but less than about 30 minutes in an aqueous solution having a temperature in the range from 100° to 212° F and consisting of from 0.3 to 70% by volume hydrogen peroxide, water and sufficient alkaline additive to adjust said solution to a pH in the alkaline range, said solution being substantially free of heavy metal ions and maintained out of contact with all metals while said goods out of contact with all metals while said goods are immersed therein;
b. cycling a portion of said solution through a filtration means to remove solid impurities therefrom while maintaining the volume, composition and pH of said solution in contact with said goods substantially the same;
c. rinsing said goods with water to wash said aqueous solution therefrom; and
d. drying said goods.

2. A process, as claimed in claim 1, wherein said aqueous solution has a temperature in the range 160° to 212° F and includes 1 to 50% by volume hydrogen peroxide, and said time to achieve commercial brightness is from ½ to 7 minutes.

3. A process, as claimed in claim 1, wherein said aqueous solution has a temperature in the range 160° to 212° F, a pH of 10 to 14, and includes 0.5 to 15% by volume hydrogen peroxide, said goods being immersed therein for less than about 3½ minutes.

4. A process, as claimed in claim 1, wherein said aqueous solution has a temperature in the range 160° to 212° F, a pH from above 7 to 10, and includes 1 to 50% by volume hydrogen peroxide, said goods being immersed therein for less than about 3½ minutes.

5. A process, as claimed in claim 1, wherein said aqueous solution has a temperature in the range 100° to 150° F, a pH from above 7 to 8 and includes 30 to 70% by volume hydrogen peroxide, said goods being immersed therein for about 15 to 30 minutes.

6. The process, as claimed in claim 1, wherein said process includes the steps of maintaining said solution in a plurality of containers and successively immersing said goods into the solution in different ones of said containers.

7. A process, as claimed in claim 6, wherein the portion of each of said containers in contact with said solution is glass.

8. A process, as claimed in claim 1, wherein said hydrogen peroxide is electronic grade.

9. A process as claimed in claim 1, wherein said water of said solution is selected from the group consisting of deionized and distilled water.

10. A process, as claimed in claim 1, wherein said solution further includes a fluorescent whitener.

11. A process as claimed in claim 1, wherein said process is continuous and said cycling is continuous.

12. A process, as claimed in claim 1, wherein said simultaneous scouring, desizing and bleaching is accomplished by immersing said goods in a single tank containing said solution and said cycled portion of said solution is continuously purified to remove contaminants therefrom.

13. A process, as claimed in claim 1, including the step of immersing said goods in water for up to 3½ minutes prior to immersing said goods in said hydrogen peroxide solution, said water having a temperature from just above ambient to 212° F and being substantially free of heavy metal ions and maintained out of contact with all metals while said goods are immersed therein.

14. A process, as claimed in claim 3, wherein said water temperature is in the range 104° to 212° F.

15. A process, as claimed in claim 1, including the step of immersing said goods in an alkaline scour solution for from 5 seconds to 3½ minutes prior to immersing said goods in said hydrogen peroxide solution, said alkaline scour solution having a temperature in the range 160° - 212° F and a pH from 10 to 14.

16. A process, as claimed in claim 15, wherein said goods are immersed in said alkaline scour solution for from 1 to 3 minutes.

17. A process, as claimed in claim 16, wherein said alkaline scour solution is in the range 11.8 to 13.5.

18. A process, as claimed in claim 17, wherein said alkaline scour solution temperature is in the range 185° to 212° F.

19. A process, as claimed in claim 15, wherein said alkaline scour solution contains 1 to 10% by volume hydrogen peroxide therein.

20. A process, as claimed in claim 15, wherein a portion of said alkaline scour solution is cycled through a purification means to remove impurities therefrom while maintaining the volume, composition and pH of said alkaline scour solution in contact with said goods substantially the same.

21. A process, as claimed in claim 15, including the step of immersing said goods in an acid solution for from 1 to 10 seconds prior to immersing said goods in said hydrogen peroxide solution, said acid solution having a temperature in the range 45° to 212° F and a pH less than about 3.

22. A process, as claimed in claim 21, wherein said acid solution pH is 0.5 to 1.

23. A process, as claimed in claim 21, wherein said acid solution temperature is in the range 45° to 100° F.

24. A process, as claimed in claim 21, wherein said goods are immersed in said acid solution for from 1 to 5 seconds.

25. A process, as claimed in claim 21, wherein a portion of said acid solution is cycled through a purification means to remove impurities therefrom while maintaining the volume, composition and pH of said acid solution in contact with said goods substantially the same.

26. A process, as claimed in claim 21, wherein said goods are immersed in said acid solution prior to being immersed in said alkaline scour solution.

27. A process, as claimed in 21, wherein said goods are immersed in said alkaline scour solution prior to being immersed in said acid solution.

28. A process, as claimed in claim 5, wherein said peroxide concentration is 40 to 70% by volume.

29. A process, as claimed in claim 5, wherein said solution temperature is above about 112° F.

30. A process, as claimed in claim 1, wherein said alkaline additive is a hydroxide additive.

31. A process, as claimed in claim 14, wherein said immersion time in said hydrogen peroxide solution does not exceed 3½ minutes.

32. A process, as claimed in claim 15, wherein said immersion time in said hydrogen peroxide solution does not exceed 3½ minutes.

33. A process, as claimed in claim 21, wherein said immersion time in said hydrogen peroxide solution does not exceed 3½ minutes.

* * * * *